US006435303B1

(12) United States Patent
Warnaka

(10) Patent No.: US 6,435,303 B1
(45) Date of Patent: Aug. 20, 2002

(54) SOUND ABSORBING STRUCTURE

(75) Inventor: Glenn E. Warnaka, State College, PA (US)

(73) Assignee: Future Technologies LLC, State College, PA (US)

( * ) Notice: Subject to any disclaimer, the term of this patent is extended or adjusted under 35 U.S.C. 154(b) by 0 days.

(21) Appl. No.: 09/483,802

(22) Filed: Jan. 15, 2000

(51) Int. Cl.[7] ..... E04B 1/82
(52) U.S. Cl. ..... 181/286
(58) Field of Search ..... 181/286, 290, 181/292, 293, 295

(56) References Cited

U.S. PATENT DOCUMENTS 1,945,308 A * 1/1934 Fischer ..... 154/44
4,141,433 A * 2/1979 Warnaka ..... 181/286
5,959,265 A * 9/1999 Van Kighten ..... 181/286
6,082,489 A * 7/2000 Iwao et al. ..... 181/286
6,145,616 A * 11/2000 Ewanek ..... 181/224

* cited by examiner

*Primary Examiner*—Robert E. Nappi
*Assistant Examiner*—Kim Lockett

(57) ABSTRACT

A panel-like sound absorbing structure comprising an upper surface, a lower surface separated from said upper surface and a side surface connecting said upper surface to said lower surface. In the interior of the structure there are a plurality of quarter wave sound absorbing channels disposed in a planar array between said upper and lower surface, said channels having a first, sound-receiving, end into which sound waves are introduced and an end remote from the sound-receiving end, and means for introducing sound waves into said first end of said quarter wave sound absorbing channels. The distance between said upper surface and lower surface is not greater than about 1". Alternatively, the interior of the structure can contain one or more Helmholtz resonator cavities.

11 Claims, 12 Drawing Sheets

LAYOUT OF INDIVIDUAL FLAT HELMHOLTZ RESONATOR CAVITIES

APPROXIMATE SCALE 1 / 4 " = 1"

THREE-DIMENSIONAL VIEW OF FLAT HELMHOLTZ ABSORBER SHOWING THE RESONATOR MOUTHS

ACOUSTIC ABSORPTION OF FLAT HELMHOLTZ ABSORBER MEASURED IN AN IMPEDANCE TUBE

SOUND ABSORBING STRUCTURE

BACKGROUND OF THE INVENTION

The present inventor is also the inventor of the sound absorbing structures set forth in U.S. Pats. Nos. 4,141,433; 4,243,117; and 4,339,018, incorporated herein by reference, which relate to the absorption of sound utilizing compact lightweight structures typical of those used in aerospace construction. In such structures, a plurality of specifically deployed adjacent cavities serve to act as an array of sound absorbing members.

In addition to the above referenced patents, the present inventor is also the inventor of co-pending patent application Ser. No. 09/320,415 entitled, "Structure for Absorbing Sound." The structures described in this co-pending application make use of any material as a sound absorber, not depending on or requiring the use of materials such as open cell plastic foam or fibrous materials that have inherently high sound absorption. The structures described in this co-pending application employ the quarter-wave resonator principle.

OBJECT OF THE INVENTION

It is an object of the present invention to create an absorber that has a very wide frequency range of absorption which would have a wide variety of specialized applications including ceiling and wall treatments, machinery enclosures, and office partitions using the advantages of interference between closely spaced quarter wave resonators and/or Helmholtz resonators.

These and other objects have been accomplished by novel sound absorption structures that are essentially flat and very compact.

BRIEF DESCRIPTION OF THE INVENTION

New sound absorbing structures that are very flat and compact have been discovered. The sound absorbing qualities of such structures are dependent on the structure=s geometry and not the material of construction. The structures do not depend on or require the use of materials such as open cell plastic foam or fibrous materials that have inherently high sound absorption. These structures use the advantages of interference between closely spaced quarter wave resonators and/or Helmholtz resonators.

This invention may take many forms. It is basically a multi-ply sandwich construction consisting of a front and rear face of sound reflecting material and an inner core made up of walls defining a series of quarter wave resonators and/or Helmholtz resonators with a continuous progression of resonant frequencies from the lowest desired frequency for sound absorption to the highest desired frequency for sound absorption.

BRIEF DESCRIPTION OF THE DRAWING

The invention is further described in conjunction with the following drawings, in which.

The figures are not necessarily drawn to scale.

DESCRIPTION OF THE INVENTION

Figure 1:
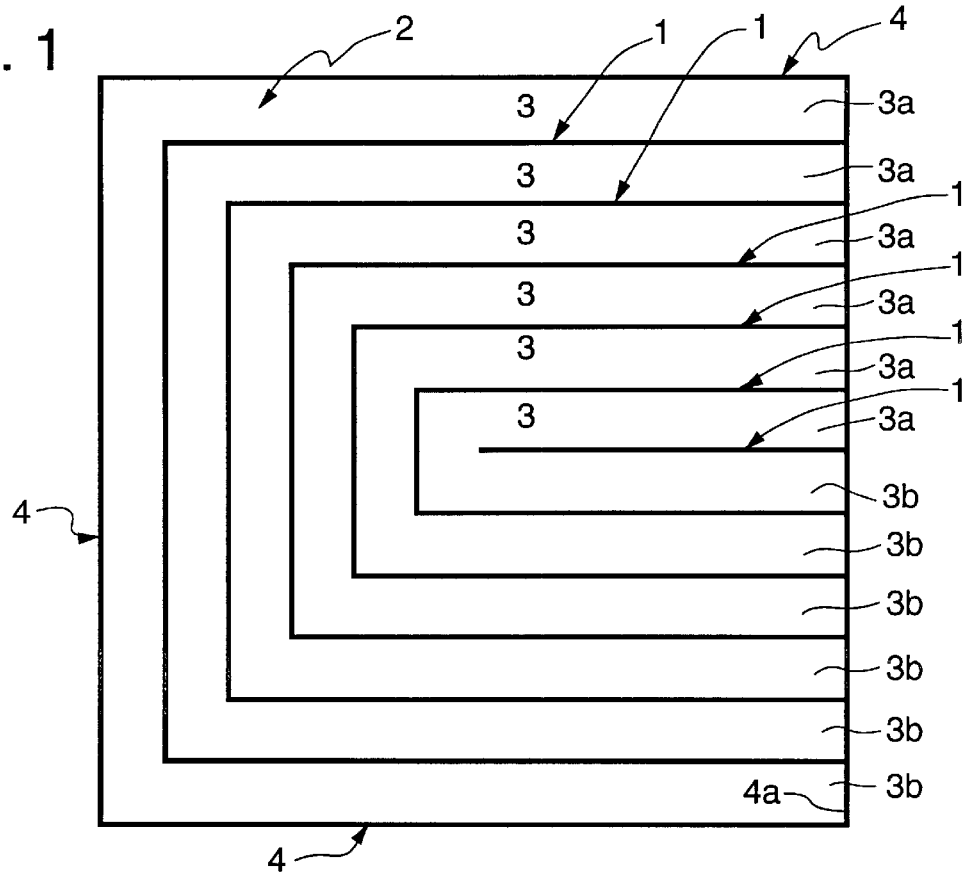
FIG. 1 is a top view, with the upper surface removed, of one embodiment of the present invention.

Many arrangements of the flat sound absorber of the present invention are possible. One typical arrangement is shown in FIG. 1, in which a square shaped absorber is depicted. Here a plurality of walls 1 are arranged on a sound reflecting rear surface 2. The walls 1 are arranged to define, once a front surface (not shown) is placed on top of the structure, a number of quarter wave resonant channels 3. Each channel 3 shares a wall with its immediately adjacent neighbor. The channels are of differing lengths to absorb differing sound frequencies and are disposed in continuous progression of resonant frequencies from the lowest desired frequency for sound absorption to the highest desired frequency for sound absorption. The channels are disposed within the confines of sidewall 4 in a planar array. Each channel has a first, sound-receiving end 3*a* into which sound waves are introduced and an end 3*b* remote from the sound-receiving end 3*a* that is defined by an acoustically reflective barrier means 4*a*, which in this case is the inner surface of side wall 4.

The length of the channels will be dependent on the sound frequencies that the absorber is designed to absorb using the quarter wave resonator principle, and can be determined as follows:

The wavelength of sound in air may be found from the well known formula $$C=f\lambda$$

Where C=speed of sound in air f=frequency in Hz $\lambda$=wave length of sound

The speed of sound varies with air temperature, density, and other factors, but for normal conditions, the generally accepted average value is 1080 ft/sec. This value does not vary greatly under most normal conditions. When the speed of sound is given in feet/sec, the wavelength of sound is correspondingly in feet. Under these conditions the following chart gives the wavelength for selected frequencies over the range of 30 Hz to 6,000 Hz. The quarter wavelengths are also given.

| Frequency (Hz) | Wave length (λ)(ft) | Wave length (λ)(in) | Quarter Wave length (λ/4)(in) |
|---|---|---|---|
| 30 | 36 | 432 | 108 |
| 50 | 21.6 | 259.2 | 64.8 |
| 100 | 10.8 | 129.6 | 32.4 |
| 500 | 2.16 | 25.92 | 6.48 |
| 1000 | 1.08 | 12.96 | 3.24 |
| 3000 | 0.36 | 4.32 | 1.08 |
| 6000 | 0.18 | 2.16 | 0.54 |

Therefore, for most conditions for airborne sound absorption, the length of the quarter wave resonator channels will vary between 108 inches and about 2 inch. In general, the sound to be absorbed will not even be as high as 6,000 Hz since there are very few sources for sound in the very high frequencies. Similarly, it is unlikely that sound below 30 Hz will need to be absorbed since there are very few sources capable of generating this very low frequency sound. However, if such sources are found, they may be absorbed by making the quarter wavelength longer in conjunction with the information given above.

The quarter wavelength resonators of this invention can also absorb sound in gases other than air and also in liquids, such as water, etc. in such cases, the quarter wavelengths for the channels are found by using the appropriate speed of sound for other media.

Figure 2:
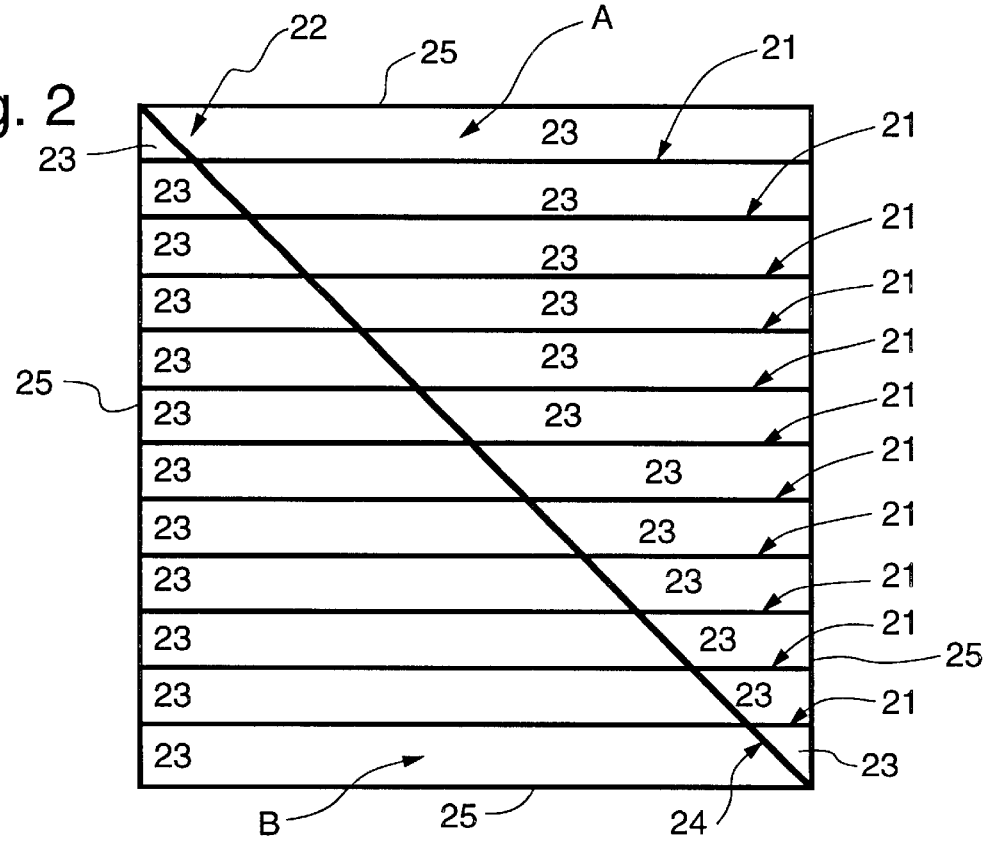
FIGS. 2 and 3 are top views, each with the upper surface removed, of two additional embodiments of the present invention.

FIG. 2 shows an arrangement in which there are two identical triangular shaped sound absorbing structures A and B separated from each other by diagonal wall 24. The separating walls 21 are arranged on a sound reflecting rear face 22 and define quarter wave resonant channels 23. All the channels are enclosed within side walls 25.

Figure 3:
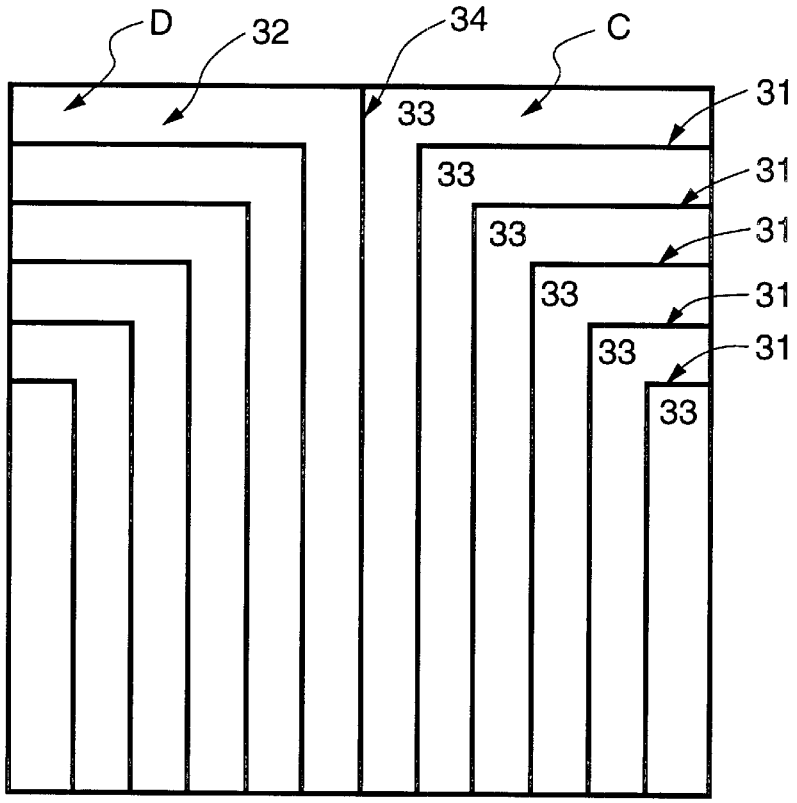

FIG. 3 shows still another arrangement in which there are two identical rectangular shaped absorbers C and D. The separating walls 31 are arranged on a sound reflecting rear face 32 and define quarter wave resonant channels 33. Sound absorbing structures C and D are separated from each other by vertical wall 34.

Figure 4:
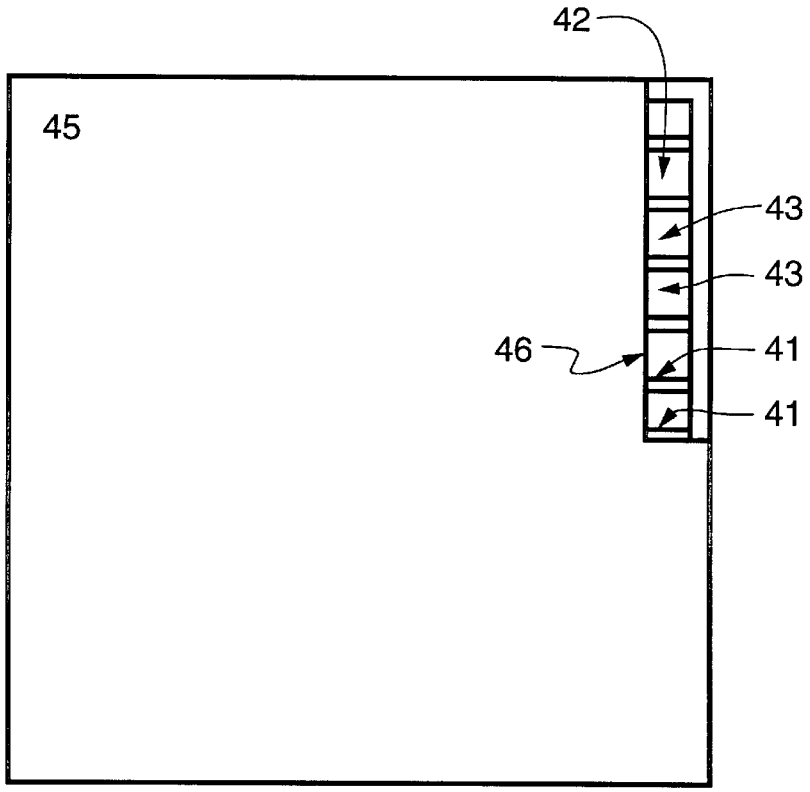
FIGS. 4–6 are top views of three additional embodiments of the present invention.

FIG. 4 shows a fully assembled absorber of the kind shown in FIG. 1. Rear face 42 defines a flat rear surface of the absorber and front face 45 defines a flat top surface of the absorber that is substantially parallel to rear face 42. Separating walls 41 are disposed between faces 42 and 45. All of the sound absorbers must have a means whereby sound waves will enter into the absorber. In the embodiment depicted in FIG. 4, top face 45 has a slot 46 cut into one corner that extends approximately half way down the absorber structure. That is, referring to FIG. 1, the slot extends to wall 1'. The purpose of slot 46 is to define an open end of the quarter wave length channels 43 and open them to sound waves that fall on the structure from above so that the sound may be absorbed.

It is a feature of the structures of the present invention that they are relatively thin. Preferably, the distance between the upper surface and the lower surface is not greater than about one inch. For many purposes layers having thickness of about ⅛ to 3⁄16 inches are quite sufficient.

Figure 5:
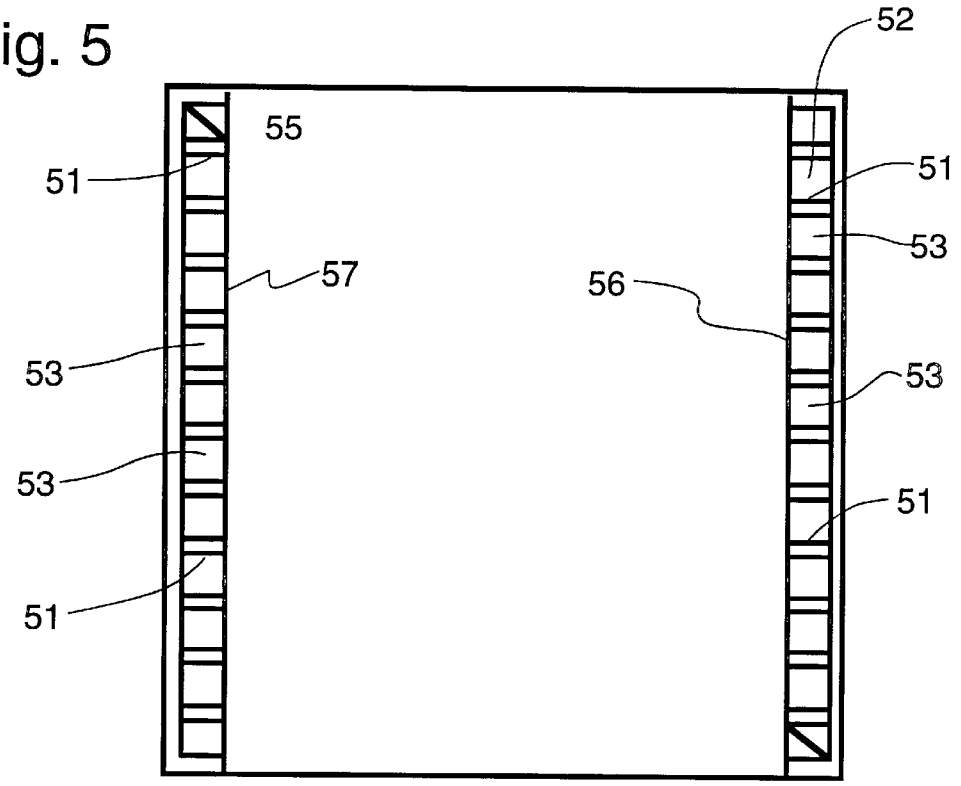

FIG. 5 shows an assembled absorber of the kind shown in FIG. 2. Rear face 52 defines a rear surface of the absorber and front face 55 defines a top surface of the absorber. Separating walls 51 are disposed between faces 52 and 55. Top face 55 has slots 56 and 57 cut the entire length of the absorber. The purpose of slots 56 and 57 is to define an open end of quarter wave length channels 53 and open them to sound waves that fall on the structure so that the sound may be absorbed.

Figure 6:
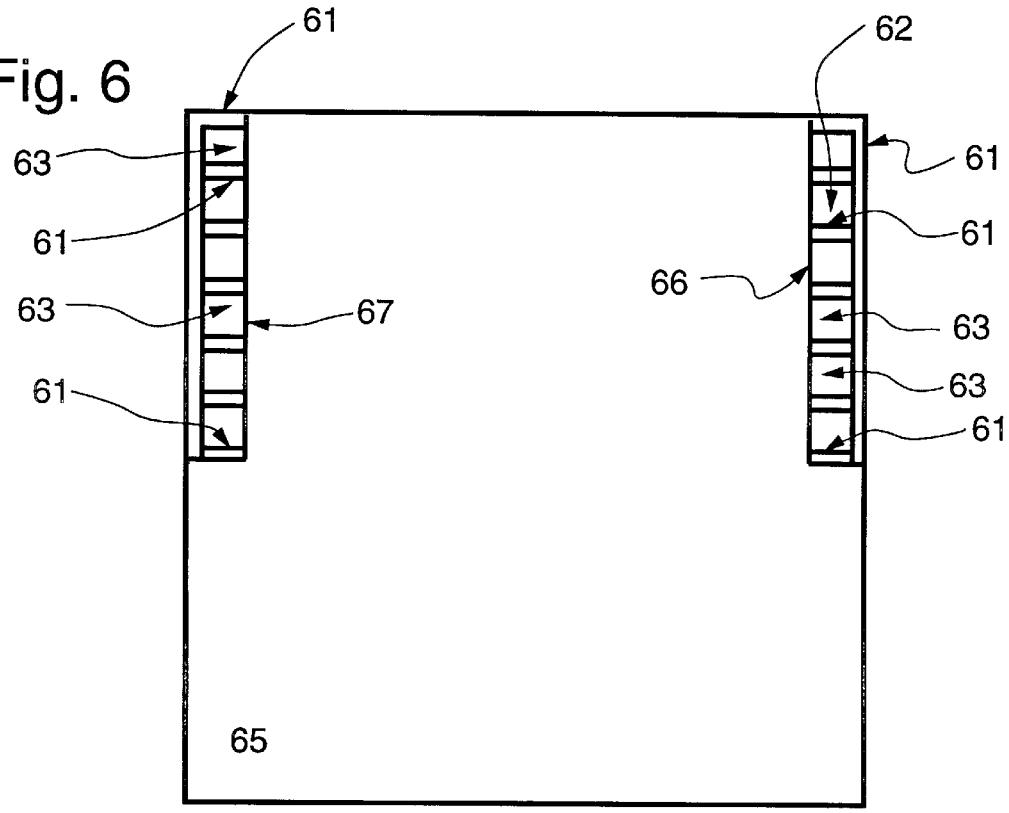

FIG. 6 shows an absorber of the kind shown in FIG. 3. Rear face 62 defines a rear surface of the absorber and front face 65 defines a top surface of the absorber. Separating walls 61 are disposed between faces 62 and 65. Top face 65 has slots 66 and 67 cut on each side of the absorber. The purpose of slots 66 and 67 is to define an open end of quarter wave length channels 63 and open them to sound waves that fall on the structure so that the sound may be absorbed.

Figure 7:
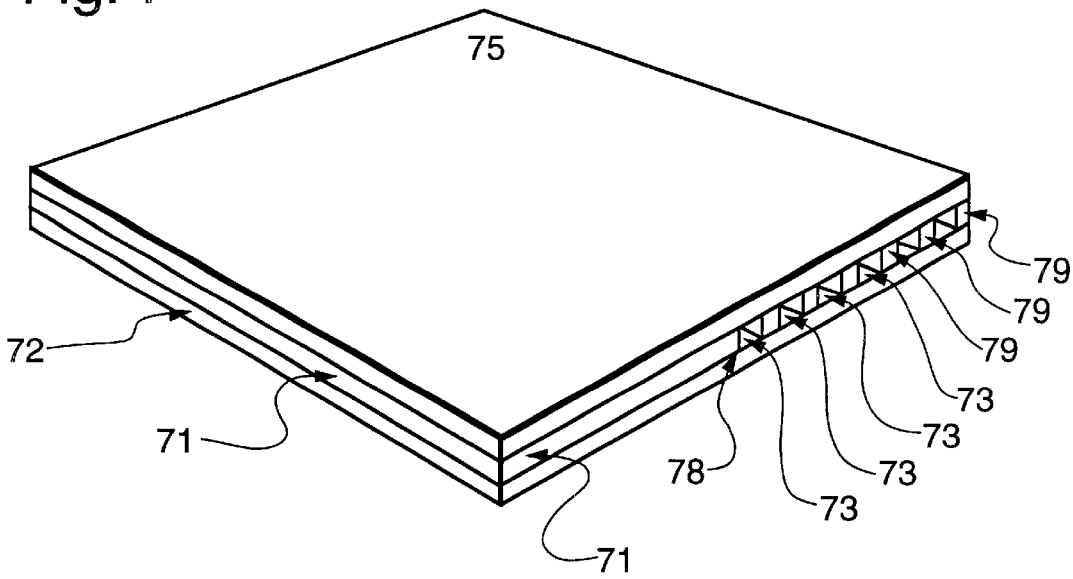
FIGS. 7 and 8 are three-dimensional views of two additional embodiments of the present invention.

FIG. 7 illustrates another way to open quarter wavelength channels 73 to absorb sound waves that may fall on the structure. Rear face 72 defines a rear surface of the absorber and front face 75 defines a top surface of the absorber. Side walls 71 are disposed between faces 72 and 75. On one side separating wall 71 is terminated at 78 exposing the ends of internal separating walls 79 and quarter wavelength channels 73. The configuration shown in FIG. 7 allows sound waves to enter the sound absorber from the side rather than the front. The configuration of FIG. 7 would correspond to the absorber configurations of FIGS. 1 and 3. If the absorber of FIG. 3 were created, then there would be a corresponding opening in side walls 71 on the other side of the absorber to thereby also expose the ends of the walls 79 and quarter wavelength channels 73 on the other side of the absorber.

Figure 8:
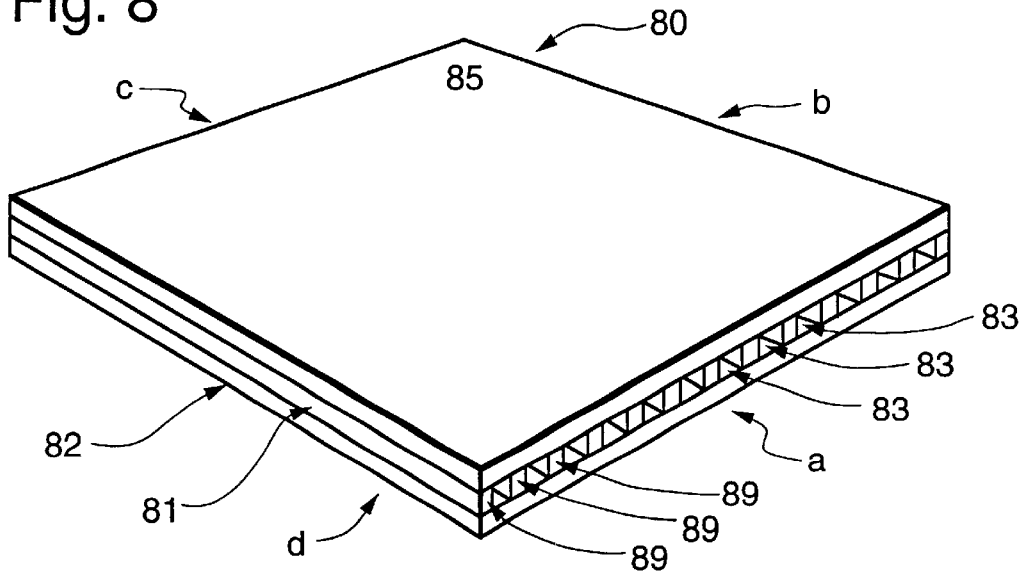

FIG. 8 shows an absorber 80 of the type shown in FIG. 2 that receives the sound wave to be absorbed at the side of the absorber. The consolidated absorber 80 is square-shaped In absorber 80 there are side walls 81 on opposite sides b and d of the absorber 80, buts no side wall 81 at opposite sides a and c, exposing the ends of the internal separating walls 89 and opening the quarter wavelength channels 83 to receive the sound to be absorbed.

Figure 9:
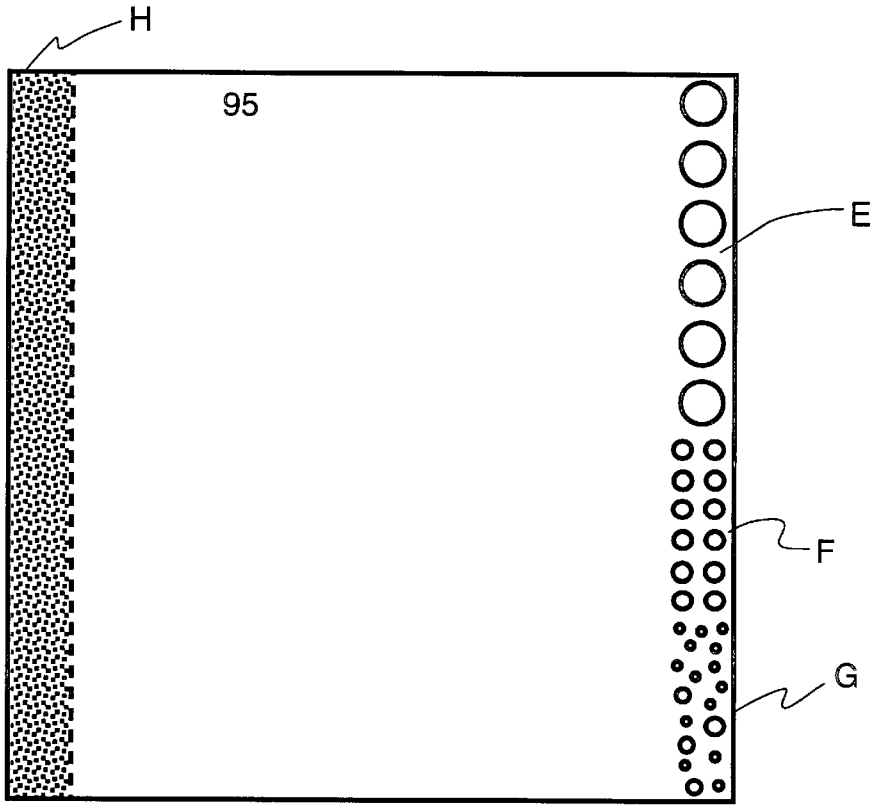
FIG. 9 is a top view of another embodiment of the present invention.

FIG. 9 shows an absorber of the type of this invention from the top view. Here top face 95 is shown perforated on the right side to provide openings to allow sound into the internal quarter wave channels. Large holes of a diameter approximately as large as the width of the quarter wavelength channels may be used as shown at E. A plurality of smaller holes may also be used as shown at F. A pattern of various hole sizes may be used as shown at G. It is understood that the holes do not have to be circle shaped. The holes may provide a further tuning of the frequencies of the quarter wave channels, and this may be considered in the overall design.

FIG. 9 also shows that the openings provided on the front of the structure that penetrate into the quarter wave length channels may be covered by a sound permeable material such as shown at H. This material may be of sound permeable cloth, paper, plastic, plastic foam, etc.

The upper or front surface of the absorber may be covered or painted with a decorative pattern, picture, drawing, etc. to make it visually pleasing in a variety of applications.

The lower or rear surface of the absorber may be bonded or otherwise affixed to an existing wall, ceiling, floor, column or other existing structure.

In some cases the rear surface may be omitted and the sound absorbing structure consisting of front surface with separating and side walls forming quarter wave length channels may be bonded or otherwise affixed directly to an existing structure such as a ceiling and, in effect, the surface of the existing structure to which the sound absorbing structure is bonded forms the rear surface of the sound absorbing structure.

The sound absorbers may also be freely hung in space in order to absorb the sound within the space.

Figure 10:
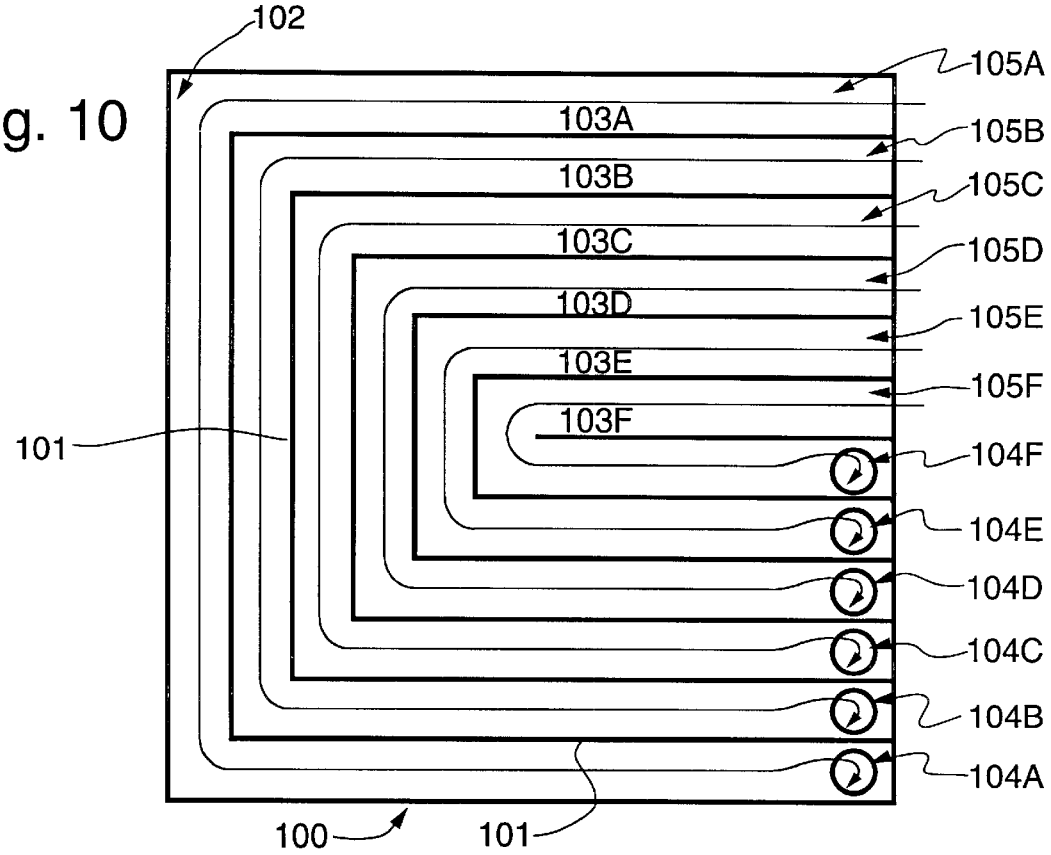
FIG. 10 is a top view, with the upper surface removed, of the upper layer of a two-layered absorber of the present invention, with the movement of sound waves graphically depicted thereon.
Figure 11:
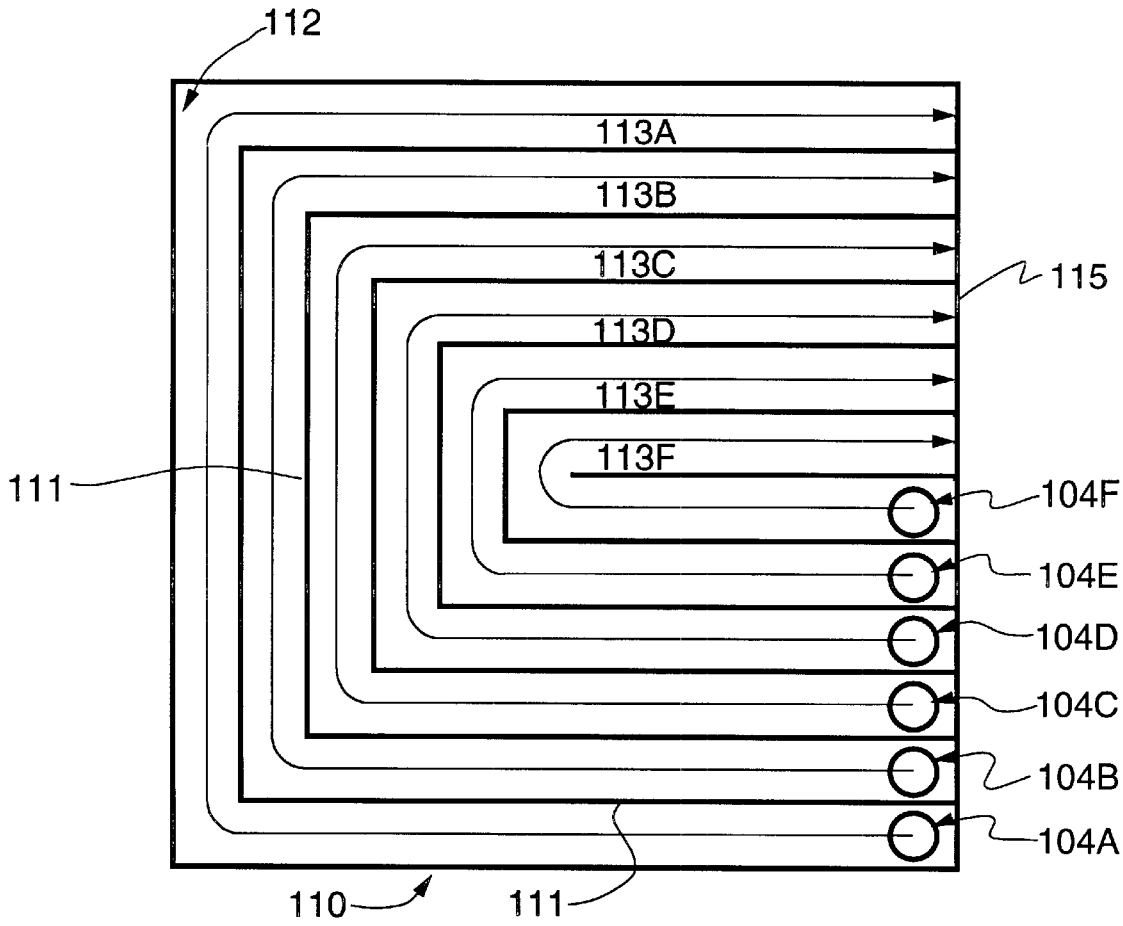
FIG. 11 is a top view, with the complete upper layer removed, of the bottom layer of a two layered absorber of the present invention and is the same structure depicted in FIG. 10, with the movement of sound waves graphically depicted thereon.

To create a structure with absorption at lower frequencies, two or more similar units may be stacked together and coupled acoustically. In such an embodiment, to save material the upper surface of a first absorber will serve as the bottom surface of a second absorber located immediately adjacent to and above said first absorber. FIG. 10 shows the upper layer 100 of a two-layer absorber which has the basic configuration of channels as shown in FIG. 1. A rear surface 102 supports separating walls 101 that divide the absorber into an upper part of six quarter wave resonant channels 103A, 103B, 103C, 103D, 103E, 103F. The rear surface 102 will also serve as the upper surface of the lower layer of the structure shown in FIG. 11. Each of the channels 103A–F has near its termination holes 104A, 104B, 104C, 104D, 104E, and 104F respectively. These holes 104A–F pass completely through rear surface 102. Sound enters through first, sound-receiving, ends 105A–F as shown, passes along channels 103A–F and passes through holes 104A–F. FIG. 11 shows the lower layer 110 of the absorber. Here a rear face 112 supports separating walls 111 that define channels 113A–F. The sound enters this lower layer through holes 104A–F from the upper layer shown in FIG. 10, as the upper face of the absorber shown in FIG. 11 is the rear face 102 of FIG. 10. After entering through holes 104A–F, the sound passes through channels 113A–F, which define a lower part of six quarter wave resonant channels, until it is stopped by side wall 115. Hence the quarter wave length resonators are formed by the combined lengths of the upper corresponding channels 103A–F and the lower lengths of the corresponding channels 113 A–F. This layered configuration can produce a sound absorber that would operate in the frequency range 46 Hz to 138 Hz in a configuration that was one foot square and about ½ inch thick. Even lower frequency absorbers could be made by acoustically interconnecting more than two layers. If the configuration were 6 inches square, then such an absorber would function in the frequency range 92 Hz to 275 Hz. Obviously the frequency range could be extended to higher frequencies by stacking higher frequency absorbers onto the low frequency absorbers. In a fully assembled structure consisting of a plurality of layers, the thickness of the structure will be determined by the number of layers necessary to create a quarter wavelength resonator for the lowest frequency of sound to be absorbed. A full range sound absorber can be made with a very thin profile of about ¾ to about one inch total thickness. The higher frequency absorbers would not have to be acoustically interconnected with other layers.

Figure 12:
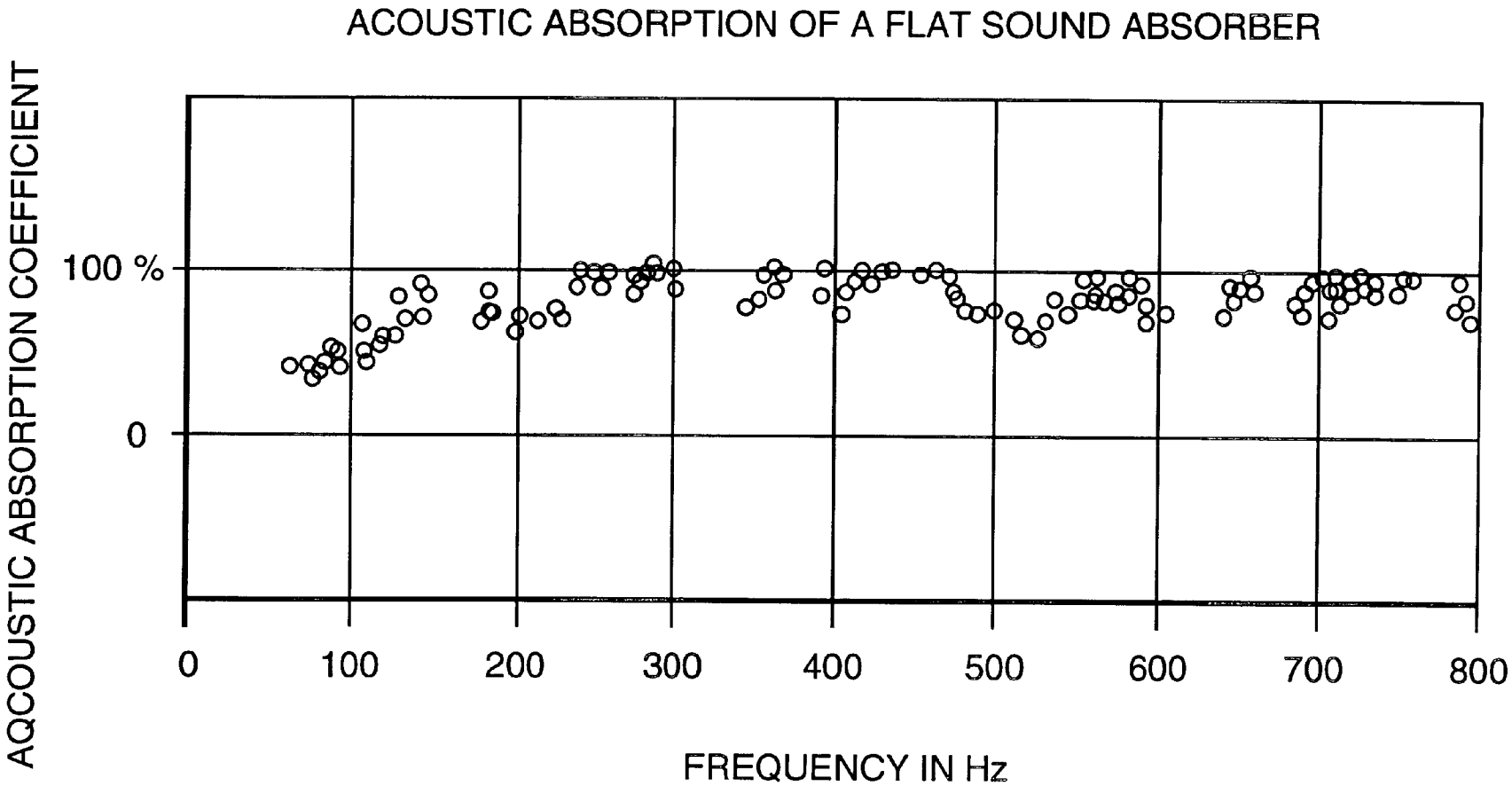
FIG. 12 is of a graph depicting the acoustic absorption qualities of a flat sound absorber of the present invention.

The performance of a three layer flat sound absorbing structure is shown in FIG. 12. The structure was designed to have very good sound absorption from about 90 Hz upward. The figure shows that this performance was attained. The three layers were designed so that the lower two layers were coupled together acoustically, as shown in FIGS. 10 and 11 above, to create absorption in the frequency range of approximately 90 Hz to 500 Hz. The uppermost layer was coupled acoustically to the environment from its upper surface. The upper layer of the lower two layers that were coupled together acoustically was coupled acoustically to the environment from its side. The uppermost layer was designed to have very good acoustic absorption from 250 Hz up. This creates an area of frequency overlap from about 250 Hz to 500 Hz between the uppermost layer and the two bottom layers. FIG. 12 shows that there is a slight increase in the acoustic absorption in this frequency band.

The treatment was made using four (4) layers of two-ply paste-board and ⅛"×⅛" Balsa Wood strips. The thickness of the treatment was ⅝".

The acoustic absorption was measured in a one foot square impedance tube using the two-microphone method.

Figure 13:
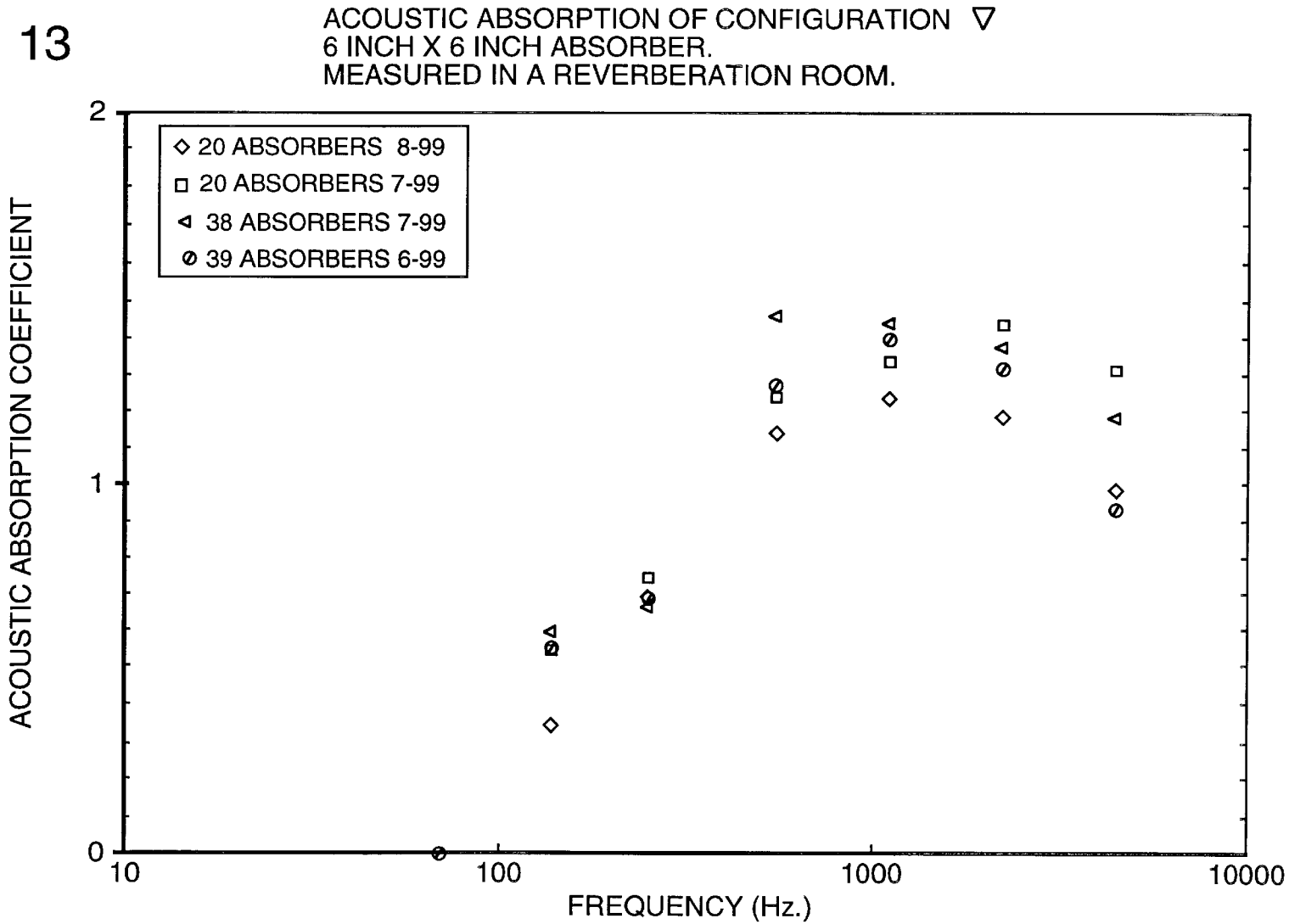
FIG. 13 is of a graph depicting the acoustic absorption of a sound absorber in accordance with applicant's co-pending application Ser. No. 09/320,415.
Figure 14:
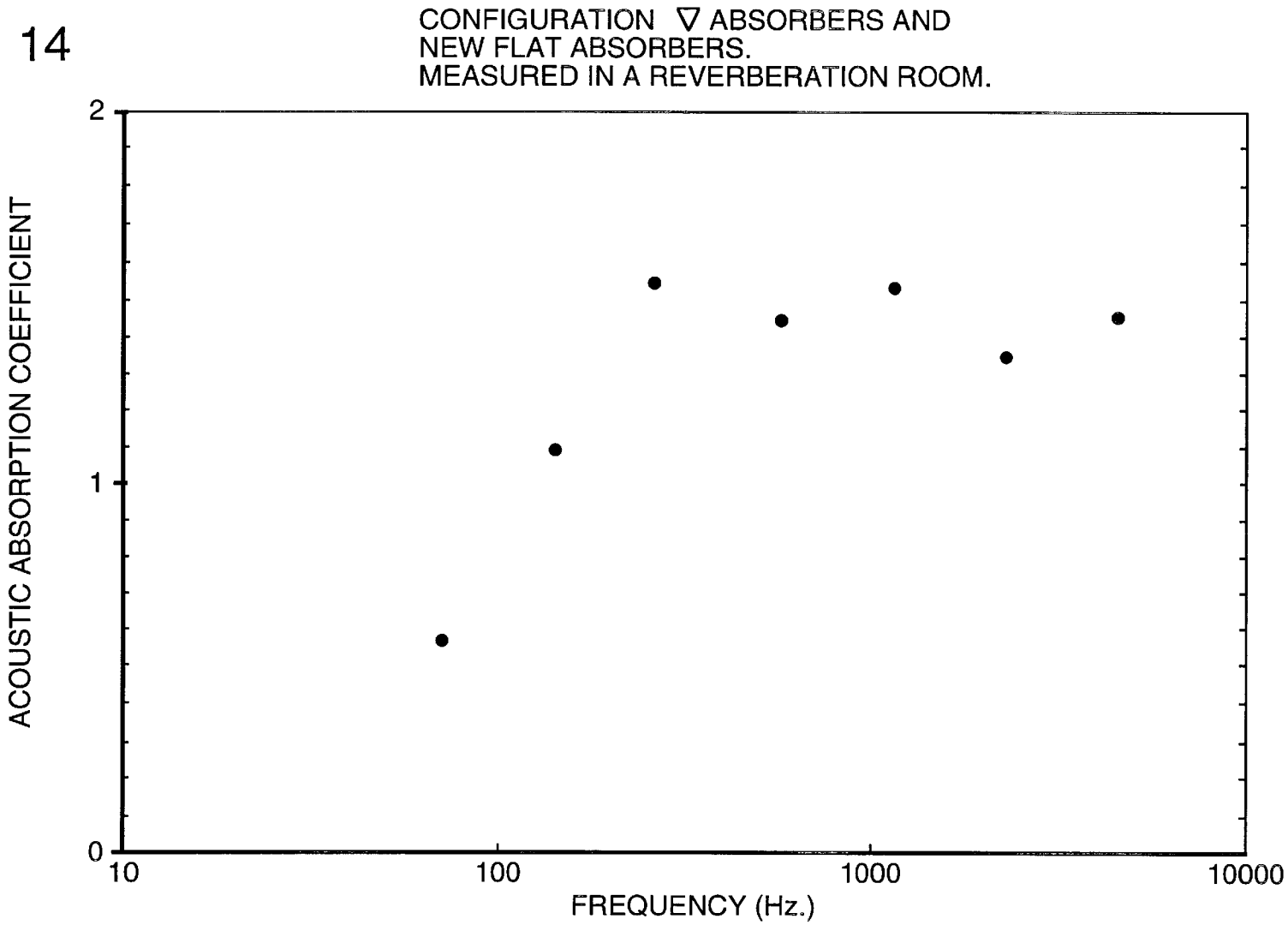
FIG. 14 is of a graph depicting the acoustic absorption of a sound absorber that employs in combination a sound absorber in accordance with applicant's co-pending application Ser. No. 09/320,415 and the flat sound absorber of the present invention.

The flat sound absorbing structures of this invention can also be combined with the structures of my current co-pending invention, "Structure for Absorbing Sound," referred to herein as "Configuration L." FIG. 13 shows the acoustic absorption of a 6 inch by 6 inch by 24 inch structure of the Configuration L type. This sound absorber provides good absorption at mid and high frequencies, as designed, but cannot provide good sound absorption at the lower frequencies unless the structure would be made very much larger. Accordingly, a flat sound absorbing structure, in accordance with the present invention was designed to augment the performance shown in FIG. 13. The flat sound absorber was made of three interconnected layers of the type shown in FIGS. 10 and 11 as already described. Reverberation room tests were again performed with the two absorbers both present in the room. The results are shown in FIG. 14. Note that the performance in the lowest three bands was greatly enhanced by the flat sound absorbing structure. All reverberation room tests were performed by measuring the decay of octave bands of random noise. A comparison of FIGS. 13 and 14 attests to the excellent sound absorbing properties of the present invention. The comparison of FIGS. 13 and 14 also shows that the sound absorbing structure Configuration L of my co-pending invention works very well in conjunction with the flat sound absorber of this invention.

Flat acoustically resonant sound absorbing structures may also be made using the principle of the Helmholtz resonator. The well known relationship that governs the frequency of the Helmholtz Resonator is $$f_n=[c/2\pi]\,[a/(\mathrm{IV})]^2$$

where c=speed of sound a=neck area l=neck length

V=volume of the resonator.

In accordance with this relationship a five (5) layer flat absorber was made using the same materials used previously, i.e., ⅛"×⅛" balsa wood strips to define the resonators and otherwise to space the layers apart and chip board (i.e. uniform density cardboard) about 1/16" thick. The overall thickness of the absorber was about 7/16 inch. The area of the absorber was 12 inches by 12 inches.

Figure 15:
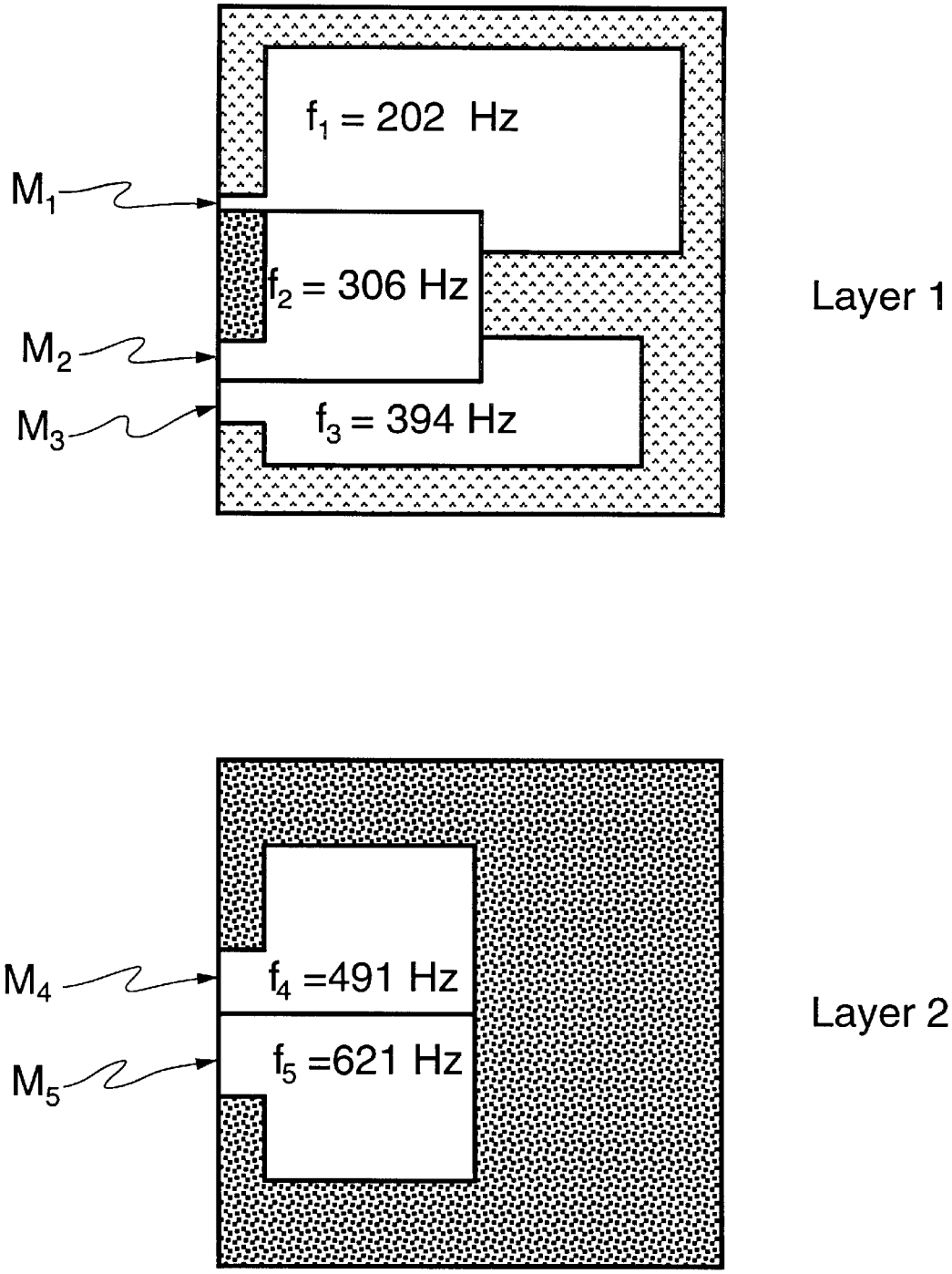
FIG. 15 is of cross sectional views of two layers of a flat absorber of the present invention, which utilizes the principal of a Helmholtz resonator.
Figure 16:
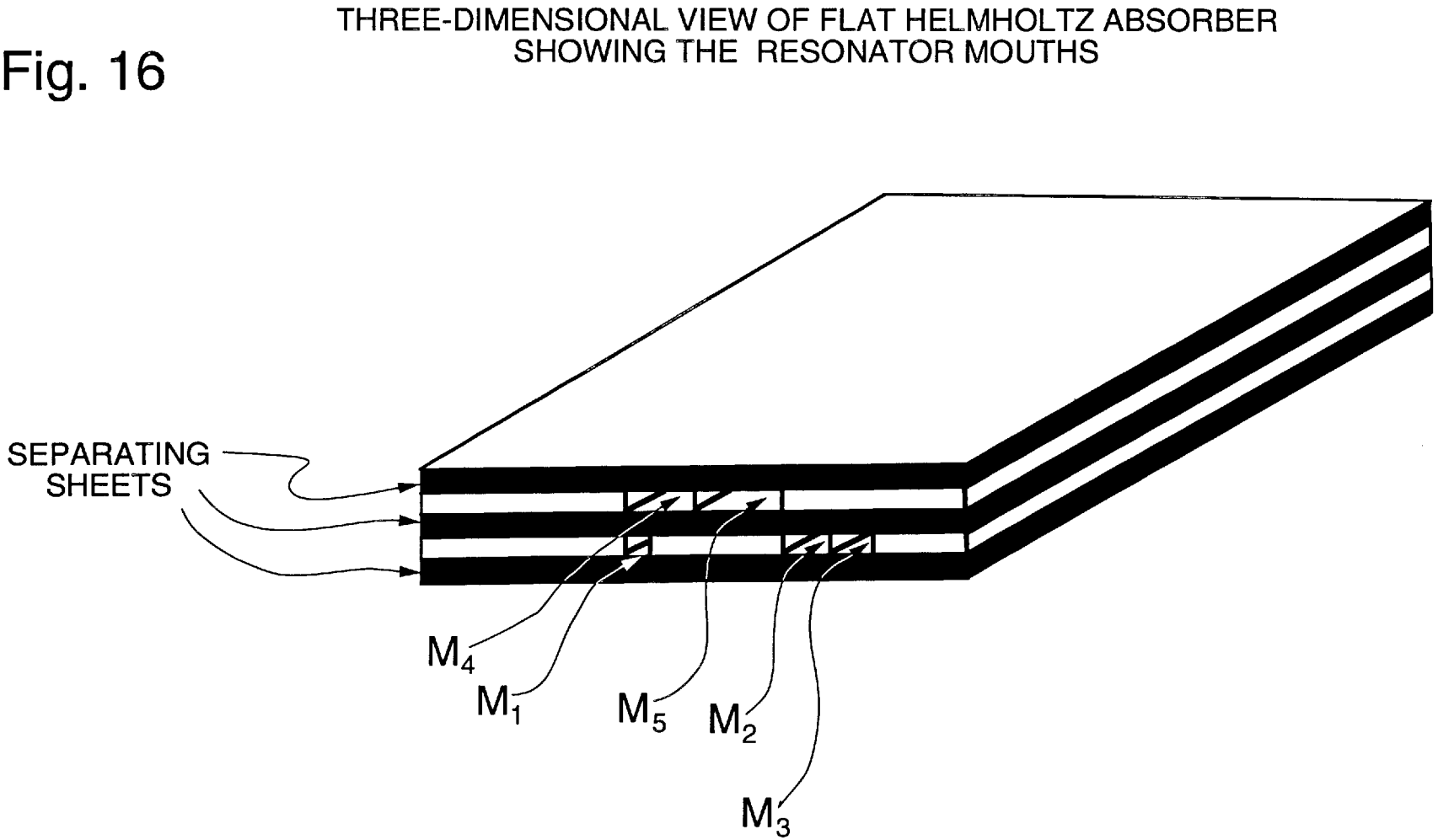
FIG. 16 is a three-dimensional view of a multi-layered flat absorber of the present invention which utilizes the principal of a Helmholtz resonator.

FIG. 15 shows the layout of the Helmholtz Absorbers. The calculated resonant frequency, f, of each resonator is given, and the mouth, M, of each resonator is defined. FIG. 16 shows a three-dimensional sketch of the absorber. The dark layers are the sheets of cardboard that act to separate the Helmholtz Absorbers and to define their top and bottom surfaces. The mouths, M, of each absorber are shown and are numbered in conformance with FIG. 15.

Figure 17:
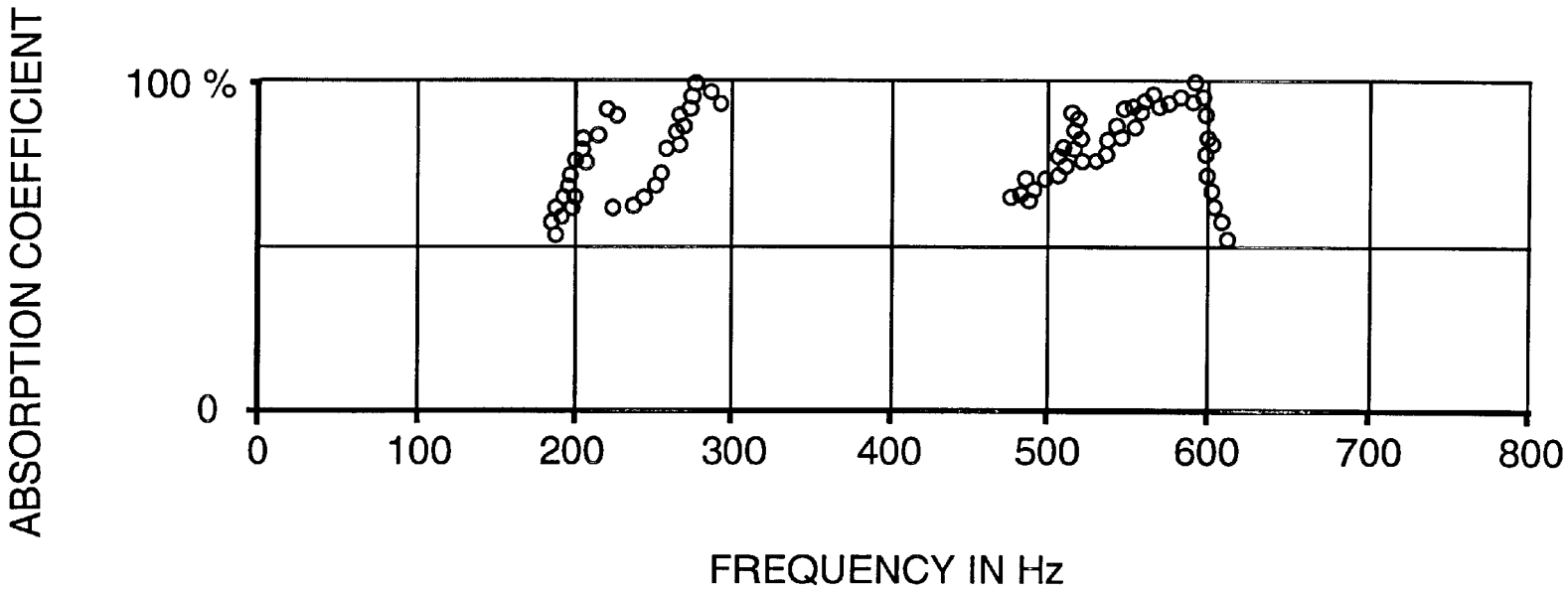
FIG. 17 is of a graph depicting the acoustic absorption of a sound absorber of the present invention which utilizes the principal of a Helmholtz resonator.

FIG. 17 shows the acoustic absorption of the flat sound absorbing structure shown in FIGS. 15 and 16. The absorption was measured by the impedance tube method. Five peaks of absorption are shown in accordance with the five Helmholtz Absorbers shown in FIG. 15.

| Frequency ($H_z$ ) Design | Measured Frequency (Hz) |
|---|---|
| 220 | 225 |
| 306 | 275 |
| 394 | 517 |
| 491 | 567 |
| 621 | 592 |

The acoustic absorption measured at the peak frequencies is high but narrow in frequency range. The results indicate that it is more difficult to create a flat sound absorbing structure using the Helmholtz resonator principle. Nevertheless, this kind of absorber can offer significant sound absorption in a limited band of frequencies.

The flat sound absorbing structures described are of a simple design. As a result, they can be easily and economically made using common materials such as plastics, metals, paper and paperboard, wood, glass, concrete and plaster etc. The configurations lend themselves to being stamped, molded, pressed, cast and other wise manufactured in a variety of inexpensive ways.

Because of its thin profile and very wide frequency range of absorption, the invention has many applications including ceiling and wall treatments, machinery enclosures, office partitions, wall paper, curtains, telephone answering stations, transportation vehicles such as automobiles, trucks, trains, buses, aircraft, ships, etc., racetracks and a wide variety of other applications. In order to fit some of these applications, the sound absorbing structures described herein would need to conform to various curved shapes. Such necessary constructions are deemed part of this invention.

The present invention may be made in a wide variety of, shapes, patterns and forms. These shapes, patterns and forms may be combined in many ways to create a variety of decorative shapes and a variety of acoustic effects.

What is claimed is:

1. A panel-like sound absorbing structure comprising an upper surface, a lower surface separated from said upper surface, a side surface connecting said upper surface to said lower surface, a plurality of quarter wave sound absorbing channels disposed in a planar array within the interior of said sound absorbing structure, said channels having a first, sound-receiving, end into which sound waves are introduced and an end remote from the sound receiving end, with said channels having a continuous progression of resonance frequencies, and means for introducing sound waves from the exterior of the structure into said first end of said quarter wave sound absorbing channels, wherein the distance between said upper surface and lower surface in not greater than about 1".

2. The sound absorbing structure of claim 1 wherein said lower surface is substantially parallel to said upper surface.

3. The sound absorbing structure of claim 2 wherein said upper and lower surfaces are substantially flat surfaces.

4. The sound absorbing structure of claim 1 wherein the means for introducing sound waves into said first end of said quarter wave sound absorbing channels is at least one opening in a surface of the structure.

5. The sound absorbing structure of claim 4 wherein the at least one opening is covered by a sound permeable material.

6. The sound absorbing structure of claim 4 wherein the at least one opening is located in the upper surface.

7. The sound absorbing structure of claim 4 wherein the at least one opening is located in the side wall.

8. The sound absorbing structure of claim 4 wherein the at least one opening is a plurality of holes of the same or of varying dimensions.

9. The sound absorbing structure of claim 1 wherein the lower surface is formed from the surface of a separately existing structure.

10. A panel-like sound absorbing structure comprising a plurality of sound absorbing layers stacked on top of each other, a) each layer comprising an upper surface, a lower surface separated from said upper surface, a side surface connecting said upper surface to said lower surface, a plurality of quarter wave sound absorbing channels disposed in a planar array between said upper and lower surface and within the confines of said side surface, said channels having a first, sound-receiving, end into which sound waves are introduced and an end remote from the sound-receiving end, wherein the distance between said upper surface and lower surface is not greater than about 1";

b) means for introducing sound waves from the exterior of said sound receiving structure into the first end of the sound absorbing channels in a layer of said structure, and c) means to acoustically interconnect adjacent layers in said structure by directing sound waves from the second end of a sound absorbing channel of at least one layer in said sound receiving structure to the first end of sound absorbing channel in another layer located immediate adjacent to said at least one layer .

11. A panel-like sound absorbing structure comprising an upper surface, a lower surface separated from said upper surface, a side surface connecting said upper surface to said lower surface, wherein the distance between said upper surface and lower surface is not greater than about 1", a plurality of Helmholtz resonator cavities located in the interior of said structure, said cavities each having a sound-receiving opening into which sound waves are introduced, and means for introducing sound waves from the exterior of said structure into the sound-receiving opening of each cavity.

* * * * *